US006867382B2

(12) United States Patent
Hoffman

(10) Patent No.: US 6,867,382 B2
(45) Date of Patent: Mar. 15, 2005

(54) MODULAR CONTACT SWITCH

(76) Inventor: Lawrence Andrew Hoffman, 877 SW. Summit View Dr., Portland, OR (US) 97225

( * ) Notice: Subject to any disclaimer, the term of this patent is extended or adjusted under 35 U.S.C. 154(b) by 0 days.

(21) Appl. No.: 10/775,921

(22) Filed: Feb. 9, 2004

(65) Prior Publication Data

US 2004/0159531 A1 Aug. 19, 2004

Related U.S. Application Data

(62) Division of application No. 10/251,552, filed on Sep. 19, 2002.

(51) Int. Cl.[7] ..... H01H 3/16
(52) U.S. Cl. ..... 200/61.62; 200/61.7
(58) Field of Search ..... 200/50.32, 307, 200/303, 61.42, 61.41, 293, 61.44, 61.7, 61.73, 61.74, 61.81, 61.82, 717; 439/594, 540.1

(56) References Cited

U.S. PATENT DOCUMENTS

| | | | | |
|---|---|---|---|---|
| 595,963 | A | | 12/1897 | McCaughey |
| 1,836,452 | A | | 12/1931 | Day |
| 1,936,452 | A | | 12/1931 | Day |
| 2,206,102 | A | | 7/1940 | Meuer |
| 3,659,063 | A | | 4/1972 | Peterson |
| 3,729,603 | A | | 4/1973 | Foltz |
| 4,190,749 | A | | 2/1980 | Erickson et al. |
| 4,406,935 | A | | 9/1983 | Montag et al. |
| 4,698,466 | A | | 10/1987 | Beck et al. |
| 4,701,582 | A | | 10/1987 | Hayashi et al. |
| 4,743,714 | A | | 5/1988 | Chien |
| 5,229,560 | A | * | 7/1993 | DeMarco ..... 200/61.7 |
| 5,410,115 | A | * | 4/1995 | Hizume et al. ..... 200/61.76 |
| D373,997 | S | | 9/1996 | Kopser |
| D384,645 | S | | 10/1997 | Kopser |
| 5,839,922 | A | * | 11/1998 | Orlando et al. ..... 439/717 |
| 5,929,404 | A | * | 7/1999 | Wecke et al. ..... 200/43.11 |
| 2004/0055858 | A1 | | 3/2004 | Hoffman |

* cited by examiner

*Primary Examiner*—Elvin Enad
*Assistant Examiner*—Lisa Klaus
(74) *Attorney, Agent, or Firm*—Ganz Law, PC; Paul J. Fordenbadner, Esq.; Bradley M. Ganz, Esq.

(57) ABSTRACT

A modular contact switch adapted to be readily assembled from a plurality of contact modules is provided. Both active contact modules and passive contact modules comprise coupling features, including but not limited to, engagement tabs and mating surfaces, to enable a removable coupling of multiple active contact modules to form active contact assemblies and passive contact modules of a passive contact assembly. The active contact modules provide a spring-biased contact that responds to the position of passive contacts of the passive contact modules. As the active and passive contact modules come into abutment and urging engagement, an electrical connection is made between the corresponding contacts. The spring-bias of the active contacts ensures that the electrical contact is made regardless of variations in tolerances and position.

27 Claims, 4 Drawing Sheets

100
110
112
112a
112b
112c
114
115
116
117
118
120
122
123
124
125
126a
126b
126c
127
130
130a
130b
150
152
152a
152b
152c
154
155
156
157
158
159
210
210a
210b
210c
212a
212b
212c
214a
214b
214c
216a
216b
216b
226
1C

MODULAR CONTACT SWITCH

RELATED APPLICATION

This application is a Divisional application claiming benefit under 35 U.S.C.§ 121 of U.S. Non-Provisional application Ser. No. 10/251,552, filed Sep. 19, 2002.

FIELD OF THE INVENTION

This invention relates to electrical contact switches, and more particularly, to a modular electrical contact switch for use in doors that is easily configurable and expandable by assembling multiple contact modules and adding additional contact modules to existing contact modules.

BACKGROUND OF INVENTION

The aggressively competitive automobile industry continuously strives to provide new and exciting features to the new model automobiles. A focus toward creature comforts and safety has been a major factor in differentiating one competitor's products from others and from premium models from budget models. Some of these features include motorized window winders, mirror positioners, mirror defoggers, keyless/wireless/remote entry systems, motorized door locks, side impact air bags, and sound system components such as door-mounted loudspeakers.

With many automobile owners not satisfied with the style, quality, and availability of the features provided by the automakers, owners have turned to aftermarket component manufacturers and even automobile kit manufacturers for satisfaction. The aftermarket component manufacturers are providing the automobile owner with an ever increasing selection of components to add to, replace, or modify the standard automobile features. Some of the features involve components for incorporation into the automobile door, which presents the challenge of providing electrical communication between door-mounted components and chassis-mounted components, such as power and signal-generating components.

Electrical communication between the automobile door, or any movable or hinged member, to the chassis-mounted components have been facilitated with the use of wiring or door switches. Electrical wires traversing the space between the door and the chassis presents problems, particularly when the door is open. These problems include potential for damage, wear, and limitations on the opening characteristics of the door itself. A significant problem is presented where additional electrical components are added to the door which require the routing of additional wires in the already over crowded wire pass-throughs. The placement location of the wires traversing between the chassis and the door is limited to the pivot region of the door. This limitation is required to minimize the length of wiring needed to traverse the gap between the chassis and the door, as well as to minimize the potential for wire damage.

As an alternative to exposed wires and for ease of placement, electrical contact switches have been used for components that are usually not operable when the door is open. The contact switch components are mounted on the door and chassis in facing relationship such that they make contact when the door is closed. The circuit connected to the switch is open when the door is open and closed when the door is closed. Electrical switches negate the need for wire pass-throughs between the chassis and the door for those components wherein an open circuit can be tolerated when the door is open. This relieves the problems associated with exposed wiring. But, the problem of expandability remains. Adding additional electrical components to the door and chassis is complicated by the type, placement and rewiring associated with the additional switches. The addition of one or more door electrical components requires the installation of one or more additional contact switches, or a single switch with additional circuits.

Accordingly, there is a need for an electrical contact switch that provides the capability for expansion of the number of circuits while negating the need for costly, time consuming, and labor intensive switch replacement, door and chassis modification, and wire routing.

SUMMARY OF INVENTION

A modular contact switch adapted to be readily assembled from a plurality of contact modules is provided. Both active contact modules and passive contact modules comprise coupling features, including but not limited to, engagement tabs and mating surfaces, to enable a removable coupling of multiple active contact modules to form active contact assemblies and, similarly, passive contact modules to form passive contact assemblies. The active contact modules provide a spring-biased contact that responds to the position of passive contacts of the passive contact modules. As the active and passive contact modules come into abutment and urging engagement, an electrical connection is made between the corresponding contacts. The spring-bias of the active contacts ensures that the electrical contact is made regardless of variations in tolerances and position.

In one embodiment, the coupling features comprise one or more tabs and corresponding notches in an alternating arrangement adapted to provide the same relationship regardless of the position of the module. That is, the module may be rotated 180 degrees and provide the same coupling arrangement as if not rotated. Therefore, only two styles of modules are required to assemble the contact switch; a module having one coupling side to be used as an end module and a module having two opposite coupling sides to be used as a module between the end modules.

The modular contact switch is particularly useful in applications wherein an electrical connection is needed across a door and a structure, such as an automobile door and chassis. Either an active or passive contact assembly, made up of active or passive contact modules, is mounted in a jamb of a door and the complimentary contact assembly is mounted in the jamb of the chassis such that when the door is closed, the active and passive contacts engage to close an electrical circuit.

Of particular functionality, the active and passive contact assemblies may be removed from the installation and additional modules added to them to increase the number of circuits that the switch controls. The modules readily decouple such that additional two-sided modules may be added to expand the capability of the switch.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentality's, procedures, and combinations particularly pointed out in the appended claims.

DESCRIPTION

In the following detailed description, reference is made to the accompanying drawings which form a part hereof wherein like numerals designate like parts throughout, and in which is shown by way of illustration specific embodiments in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

Figures 1A, 1B, 1C:
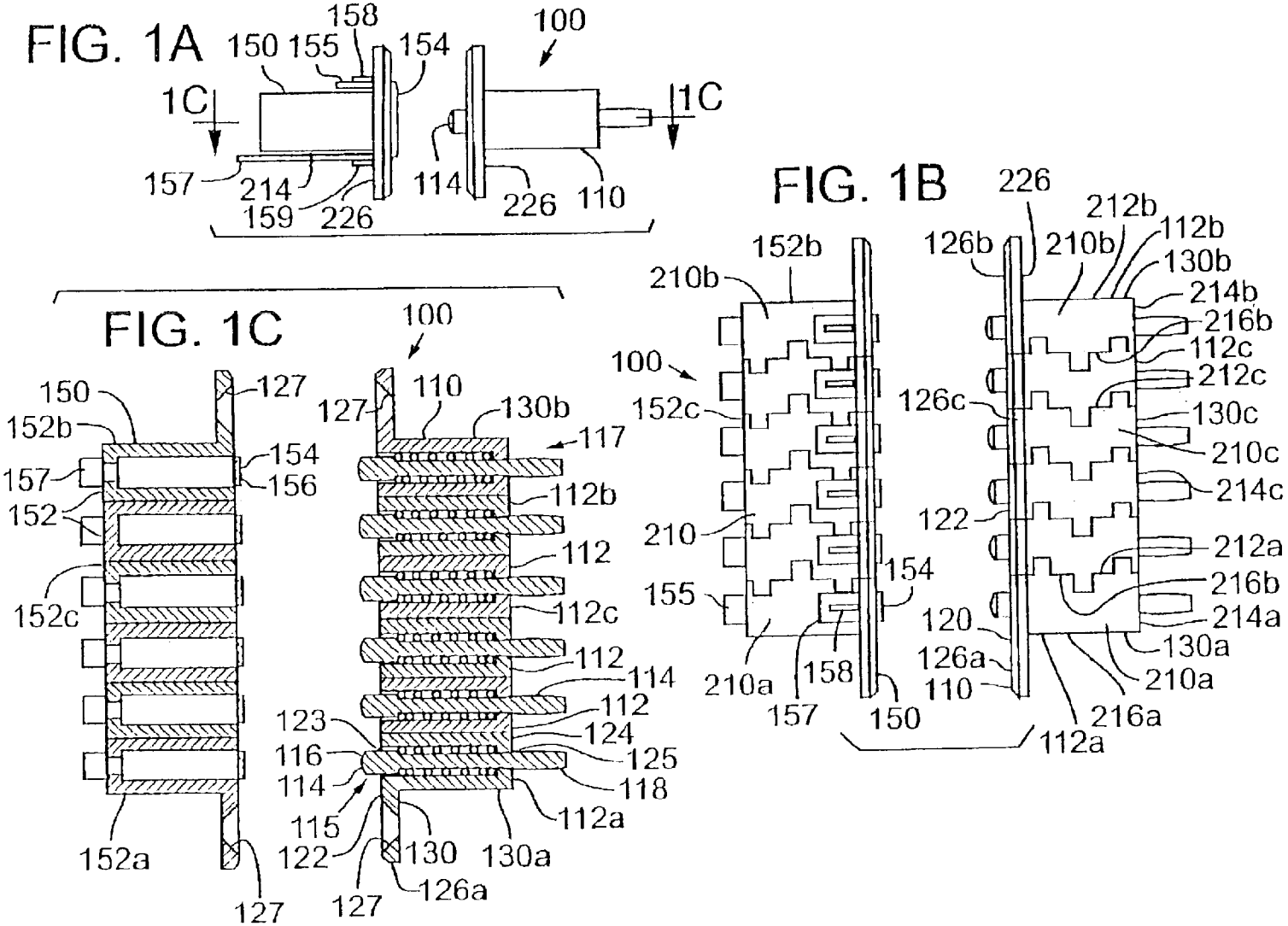
FIGS. 1A–C show a top, a side, and a cross-sectional view, respectively, of a modular contact switch in accordance with one embodiment of the invention.

FIGS. 1A–C show a top, a side, and a cross-sectional view, respectively, of a modular contact switch 100 in accordance with one embodiment of the invention. The modular switch 100 comprises an active contact assembly 110 and a passive contact assembly 150. The active contact assembly 110 comprises one or more active contact modules 112 and the passive contact assembly 150 comprises one or more passive contact modules 152.

The modular contact switch 100 is adapted to be readily assembled from active contact modules 112 and passive contact modules 152 as necessitated by a particular installation. As will be later described, the active contact modules 112 and passive contact modules 152 comprise coupling features, including but not limited to, engagement tabs and mating surfaces, to enable a removable coupling of multiple active contact modules 112 to form active contact assemblies 110 and passive contact modules 152 to form passive contact assemblies 150.

In one embodiment in accordance with the invention, the active contact assembly 110 comprises one or more of three types of active contact modules 112; a first end active contact module 112*a*, a second end active contact module 112*b*, and a center active contact module 112*c*. As shown in FIG. 1C, in one embodiment in accordance with the invention, the first end, second end, and center active contact modules 112*a–c* each comprise an active electrical contact 114 in the form of a spring-biased plunger contact. The active electrical contacts 114 are mounted in a first end contact housing 130*a*, a second end contact housing 130*b*, and a center contact housing 130*c*.

The active electrical contact 114 is comprised of electrically conductive material, for example, but not limited to copper and brass. The active contact 114 comprises an active contact front portion 115 having an active contact front end 116 and an active contact back portion 117 having an active contact back end 118. The active contact back end 118 is adapted to electrically interconnect with an electrical component, such as but not limited to, soldered wire interconnects with electrical components. The active contact 114 is biased, such as with a spring, among others, such that when the active contact front end 116 is urged as to push the active contact front end 116 further into the respective contact housings 130*a–c* by an impinging complementary contact, the bias provides a restoring force to ensure integral contact there-between.

The first end contact housing 130*a*, the second end contact housing 130*b*, and the center contact housing 130*c*, each comprise a front side 122 and a back side 124. The front side 122 comprises a front aperture 123 and the back side 124 comprises a back aperture 125. The front aperture 123 and the back aperture 125 are interconnected forming a through-bore 129. The through bore 129 comprises two internal diameters. In other embodiments in accordance with the invention, the through-bore has a single internal diameter there-through.

The front aperture 123 is adapted to slidingly receive the active contact front portion 115 of the active contact 114. The back aperture 125 is adapted to slidingly receive the active contact back portion 117. The active contact 114 is retained within the housing 130*a–c* such that the active contact front end 116 extends out of the front side 122 and the active contact back end 118 extends out of the back side 124. The active contact 114 is retained within the housing 130*a–c* by a retention means in the form of an enlargement of the active contact back portion 117 by crimping or swaging, as shown in FIGS. 1A–C. Other retention means include, but are not limited to, a fastener threaded onto the active contact back end 118 which itself has threads.

The active contact assembly 110 is assembled by coupling together at least two of the three types of active contact modules 112; the first end active contact module 112*a*, the second end active contact module 112*b*, and the center active contact module 112*c*. The active contact modules 112 are adapted to be removably coupled together via a coupling means, embodiments of which will be described below. Various embodiments of the active contact assembly 110 are anticipated by the assembly of various combinations of the three types of active contact modules 112. Examples of the various embodiments include, but are not limited to, a first end active contact module 112*a* coupled to a second end active contact module 112*b* to form a two-contact active contact assembly; a first end active contact module 112*a* coupled to a center active contact module 112*c*, which itself is coupled to a second end active contact module 112*b* to form a three-contact active contact assembly; and a first end active contact module 112*a* coupled to a center active contact module 112*c*, which itself is coupled to a second center active contact module 112*c* which itself is coupled to a second end active contact module 112*b* to form a four-contact active contact assembly.

The front side 122 of the first, second and center contact housings 130*a–c* comprises a first, second and center flange 126*a–c*, respectively, extending perpendicular to and away from the top sides 210, 210*a*, 210*b* and bottom sides 214, 214*a*, 214*b*. In addition, the first flange 126*a* extends away from the first side 212 of the first end contact housing 130*a*, and the second flange 126*b* extends away from the second side 216 of the second end contact housing 130*b*. Upon assembly of the active contact assembly 110, the front sides 122 and, therefore, the flanges 120*a–c*, are positioned substantially coplanar with each other, forming a flat active assembly flange 120.

The first flange 126*a* and the second flange 126*b* further comprise flange apertures 127. The flange apertures 127 provide attachment means to affix the active contact assembly 110 to a structure with appropriate fasteners through the flange apertures 127 and into the structure. Other methods of attachment are also within the scope of the invention.

Upon assembly of the active contact assembly 110, the active contacts 114 are retained in their respective housing 130*a–c* in parallel and coplanar relationship, with each active contact end 116 extending substantially the same predetermined distance from the front sides 122 of the housings 130*a–c*. In other embodiments in accordance with the invention, each active contact end 116 extends a predetermined distance from the front sides 122 of the housings 130*a–c* to accommodate a predetermined application, such as with a contact very close to the hinge of a door.

Figure 2A:
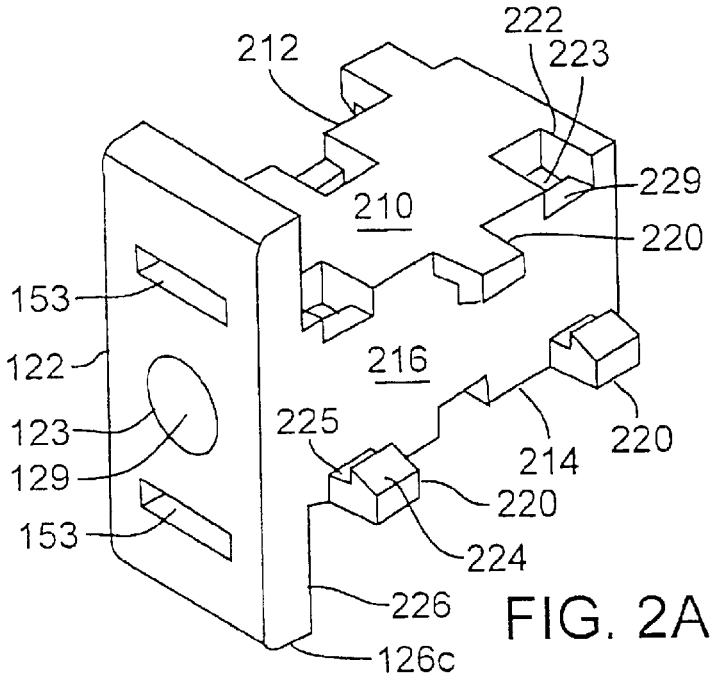
FIGS. 2A–C show a front perspective, a top, and a cross-sectional view, respectively, of a center contact housing of the center active contact module.
Figure 2B:
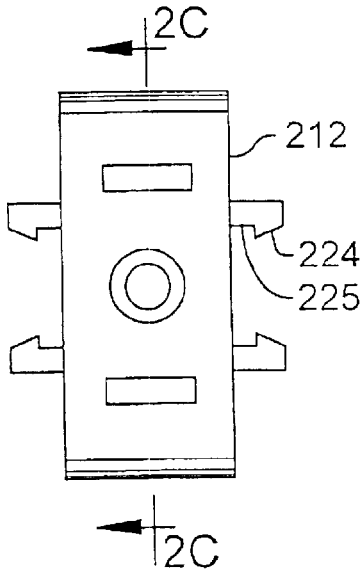
Figure 2C:
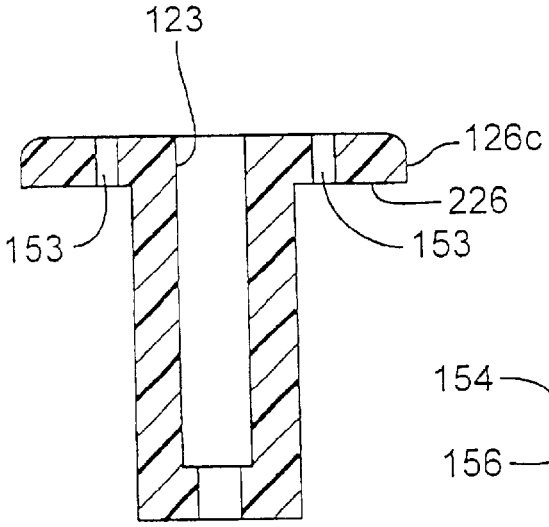

FIGS. 2A–C show a front perspective, a top, and a cross-sectional view, respectively, of the center contact housing 130*c* of the center active contact module 112*c*. The center contact housing 130*c* comprises a top side 210, a bottom side 214, a first side 212, and a second side 216. Although the terms "top," "bottom," and "side" are used, the terms are merely used to describe the various features of the center contact housing 130*c*, and are not intended to limit the orientation of the center contact housing 130*c* in any manner. In one embodiment, the top side 210 and the bottom side 214 are generally flat.

The second side 216 comprises engaging coupling tabs 220, which are received in corresponding mating coupling notches 222 of other contact housings 130*a–c*, which will be further described below. The arrangement and configuration of the coupling tabs 220 and coupling notches 222 is provided to suite the particular purpose of removably coupling respective contact housings 130*a–c*. As shown in FIGS. 2A and 2B, the coupling tabs 220 and coupling notches 222 are arranged in a staggered pattern, such that the second side 216 comprises a coupling tab 220 between two coupling notches 222 adjacent the top side 210, and a coupling notch 222 between two coupling tabs 220 adjacent the bottom side 214.

The first side 212 has a similar but contra-pattern of coupling tabs 220 and coupling notches 222; that is, the coupling tabs 220 and coupling notches 222 are in switched positions as compared with the second side 216. As will be discussed below, the first end contact housing 130*a* also comprises a first side 212, and the second end contact housing 130*b* also comprises a second side 216 for coupling engagement with complementary mating sides of other contact housings 130*a–c*.

This arrangement provides for suitable coupling engagement between a first side 212 of a contact housing 130*a,c* and a second side 216 of another contact housing 130*b,c*. The arrangement of the coupling tabs 220 and coupling notches 222 also provides that the active contact modules 112*a–c* can only be assembled in one preferred orientation; that is, all active contact front ends 116 are oriented in only one direction.

The features of the coupling tabs 220 and coupling notches 222 can be of many forms that are suitable for proper removable engagement. FIGS. 2A and 2B show an embodiment in accordance with the invention, wherein the coupling tabs 220 comprise a resilient arm 225 integrally coupled to the contact housing 130*c* at a proximal end with the arm 225 having an inwardly projecting wedge-shaped locking feature 224 on the distal end. The coupling notches 222 comprise a depression 223 adapted to accept the locking feature 224 therein. Upon engagement of a coupling tab 220 with a coupling notch 222, the arm 225 resiliently deflects outwardly caused by the engagement of the wedge-shaped locking feature 224 against a lip 229 at the coupling notch 222 until the locking feature 224 engages the complementary depression 223 wherein the arm 225 returns to the initial state.

The configuration of the coupling tabs 220 and coupling notches 222 is provided to suit the particular purpose for a secure but removable coupling engagement there-between. Depending on the shape of the locking feature 224 and the resiliency of the arm 225, the assembled modules 112 can be decoupled, such as by pulling or twisting apart two adjacent modules 112. For example, but not limited thereto, a locking feature 224 in the form a double-sloped wedge, i.e., a wedge having two oppositely facing slopes, wherein the arm 225 is adapted to deflect upon assembly and deflect again upon disassembly. Another method of disassembly includes, but is not limited to, the use of a tool to pry the arms 225 out of engagement.

Referring again to FIG. 1B, a top view of the first end contact housing 130*a* is shown in accordance with an embodiment of the invention. The first end contact housing 130*a* comprises atop side 210*a*, a bottom side 214*a* (hidden in this view), a first side 212*a*, and a second side 216*a*. Although the terms "top," "bottom," and "side" are used, the terms are merely used to describe the various features of the first end contact housing 130*a*, and are not intended to limit the orientation of the first end contact housing 130*a* in any manner; In one embodiment, the top side 210*a*, the bottom side 214*a*, and the second side 216*a* are all generally fiat; that is, they do not comprise any coupling elements. In another embodiment, the top side 210*a*, the bottom side 214*a*, and the second side 216*a* are curvilinear forming one merged rounded side. In another embodiment, the top side 210*a*, the bottom side 214*a*, and the second side 216*a* have other profiles suitable for insertion into a structural cavity during installation for a specific installation.

The first side 212*a* comprises engaging coupling tabs 220 and coupling notches 222 of the same form and type as the first side 212*c* of the center contact housing 130*c*. Therefore, the first side 212*a,c* of the first end and center contact housings 130*a,c* are adapted to engage with the second side 216*b,c* of the second end and center contact housings 130*b,c*.

Referring again to FIG. 1B, a top view of the second end contact housing 130*b* is shown in accordance with an embodiment of the invention. In similar, but complementary form as the first end contact housing 130*a*, the second end contact housing 112*b* comprises a top side 210*b*, a bottom side 214*b* (hidden in this view), a first side 212*b*, and a second side 216*a*. Although the terms "top," "bottom," and "side" are used, the terms are merely used to describe the various features of the second end contact housing 130*b*, and are not intended to limit the orientation of the second end contact housing 130*b* in any manner. In one embodiment, the top side 210*b*, the bottom side 214*b*, and the first side 212*b* are all generally flat; that is, they do not comprise any coupling elements. In another embodiment, the top side 210*b*, the bottom side 214*b*, and the first side 212*b* are curvilinear forming one merged rounded side. In another embodiment, the top side 210*b*, the bottom side 214*b*, and the first side 212*b* have other profiles suitable for insertion into a body structure during installation for a specific installation.

The second side 216*b* comprises engaging coupling tabs 220 and coupling notches 222 of the same form and type as the second side 216*c* of the center contact housing 130*c*. Therefore, the second side 216*b,c* of the second end and center contact housings 130*b,c* are adapted to engage with the first side 212*a,b* of the first end and center contact housings 130*a,c*.

Referring again to FIGS. 1A–C, the passive contact assembly 150 has substantially the same form and function as the active contact assembly 110, but for the integration of the passive contact 154 in place of the active contact 114. In one embodiment in accordance with the present invention, the first end, second end, and center active and passive contact modules 112*a–c*, 152*a–c* comprise the same contact housings 130*a–c*; the incorporation of an active contact 114 or passive contact 154 being the differentiating element.

Figure 3:
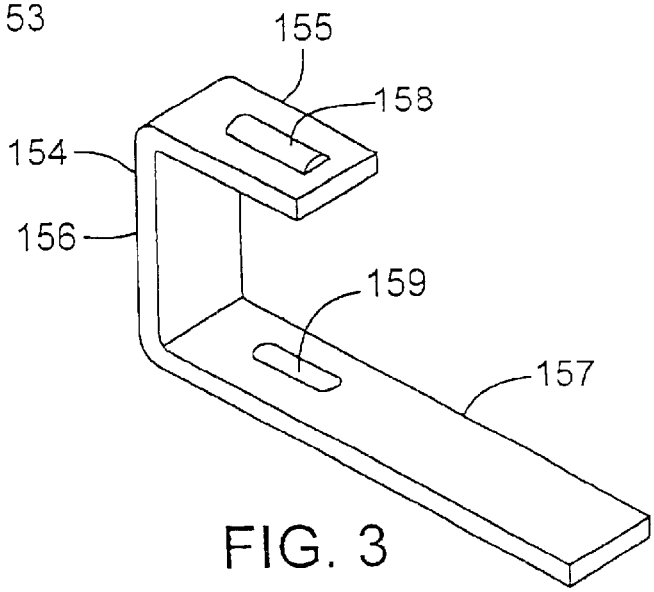
FIG. 3 is a perspective view of a passive contact in accordance with an embodiment of the invention.

FIG. 3 is a perspective view of a passive contact 154 in accordance with an embodiment of the invention. The passive contact 154 comprises a strip of conductive material, such as but not limited to, copper strip. The passive contact 154 is formed, such as, by bending, to form a first leg 155, a face 156, and a second leg 157 in a stylized "J" configuration. The first leg 155 has a predetermined length which is shorter than that of the second leg 157. The first and second legs 155, 157 comprise a detent 158. Each detent 158 is located at the same predetermined distance from the face 154 on both the first and second legs 155, 157 and extend outwardly in opposed direction.

Referring again to FIGS. 1B–C and 2A, the front side 122 of the first, second and center contact housings 130*a–c* comprise a first, second and center flange 126*a–c*. A portion of the first, second and center flange 126*a–c* extending away from the top sides 210*a–c* and bottom sides 214*a–c* further comprises a passive contact aperture 153 in the form of a slot. The passive contact aperture 153 extends through the first, second and center flange 126*a–c* adjacent to and parallel with the top 210*a–c* and bottom sides 214*a–c*, respectively.

The passive contact apertures 153 are sized to correspond to the width and thickness of the passive contact 154 such that the first and second legs 155, 157 resistively pass through the passive contact apertures 153 from the front, the resistance caused by the interaction of the detents 158 with the passive contact apertures 153. The passive contact 154 is assembled to the housing 130*a–c* by passing the first and second legs 155, 157 through the passive contact apertures 153 such that the face 156 abuts the front side 122, as shown in FIGS. 1A–C. The first and second legs 155, 157 lie adjacent the top side 210*a–c* and bottom side 214*a–c*, respectively. The predetermined distance between the detent 158 and the face 156 is adapted such that the detents 158 resistively pass through the passive contact apertures 153 but remain in abutment against the back surface 226 of the flange 126*a–c*, as shown in FIGS. 1A–C. The abutment of the detent 158 against the back surface 226 of the flange 126*a–c* ensures that the face 156 of the passive contact 154 is securely and tightly assembled to the contact housing 130*a–c* in abutment with the front side 122.

It is understood that other means for the secure and tight assembly of the passive contact 154 to the contact housing 130*a–c* are within the scope of the invention. Other means for the secure and tight assembly of the passive contact 154 to the contact housing 130*a–c* include, but are not limited to, crimping or swaging the legs 155 after assembly, retention clips assembled on the legs 154, 155 adjacent the back surface 226, a clip on the top and/or bottom sides 210, 214 engaging an aperture in one or both legs 155, 157 and a wedge-shaped bump on the top and/or bottom sides 210, 214 engaging an aperture in one or both legs 155, 157.

The predetermined length of the first leg 155 is adapted to not extend beyond the length of the contact housing 130*a–c*, wherein the second leg 157 is adapted to extend beyond the contact housing 130*a–c*. The distal end of the second leg 157 is adapted to couple with electrical components. Other lengths of the first and second legs 155, 157 are within the scope of the invention.

The advantages of a contact housing 130*a–c* that can be used for the assembly of both the active and passive contact modules 110, 150 are readily apparent. An advantage includes the reduction of parts inventory by having three types of contact housings 130*a–c* rather than six types of housings; three each for the active and passive modules 110, 115. This reduces inventory tracking and reduces the potential of depleting one type of housing over another. Another advantage is manufacturing flexibility, as active and passive modules 110, 115 may be assembled as-needed in the required configuration for a particular application.

It is understood that unique contact housings for each of the active and passive modules are also within the scope of the invention. A contact housing can be provided with only the features required for the active contact 114 and not having the passive contact apertures 153. Similarly, a contact housing can be provided that comprises only passive contact apertures 153 but not the active contact features.

The above description presented the contact assemblies 110, 150 comprising three distinct contact housings 130*a–c* having at least one of two distinct first and second mating sides 212*a–c*, 216*a–c* for removable engagement. This provides a description in a more general sense. It is recognized, though, that the contact housings 130–*c* in the embodiment of FIG. 2 present a more specific embodiment with unique features. It is recognized that the first side 212 is actually the second side 216 wherein the housing 130 is rotated 180 degrees. Further, it is recognized that the first end housing 130*a* with a first side 212*a* is actually the second end housing 130*b* with a second side 216*b* wherein the first housing 130*a* is rotated 180 degrees. Therefore, the embodiment of FIG. 2 comprises two distinct types of housings; that is, a center housing 130*c* and an end housing 130*a*. Thus, the advantages of the embodiment of FIG. 2 further includes the further reduction of parts inventory.

It is understood that the scope of the invention is not limited to coupling features in the form of coupling tabs 220 and coupling notches 222. It is also within the scope of the invention that other coupling features and their variations can be used for substantially the same purpose.

Figure 4A:
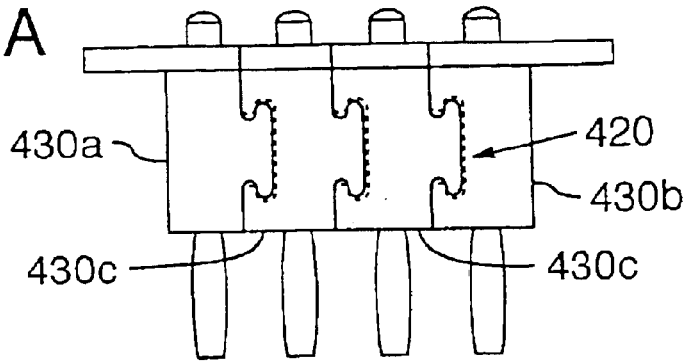
FIGS. 4A and 4B are perspective views of assembled and disassembled contact modules, respectively, comprising a tongue and groove coupling feature, in accordance with another embodiment of the invention.
Figure 4B:
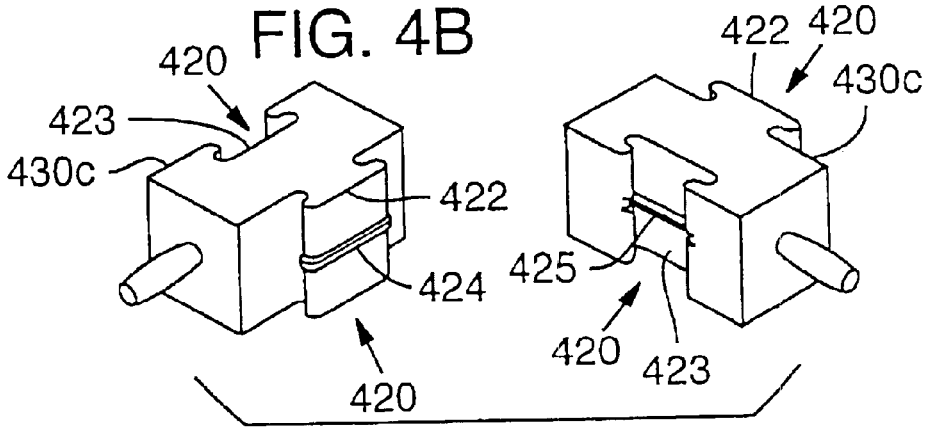

FIGS. 4A and 4B are top and perspective views of contact modules 430*a–c*, as assembled and individually, respectively, having a coupling feature 420 in the form of a tongue 422 and groove 423, in accordance with another embodiment of the invention. The tongue 422 and groove 423 are adapted to closely nest together in sliding engagement. A detent ridge 424 on the tongue 422 is adapted to click into a detent trough 425 to securely but removably couple the contact modules 430*a–c* together such that the tongue 424 and groove 423 do not slidingly disengage.

Figure 4C:
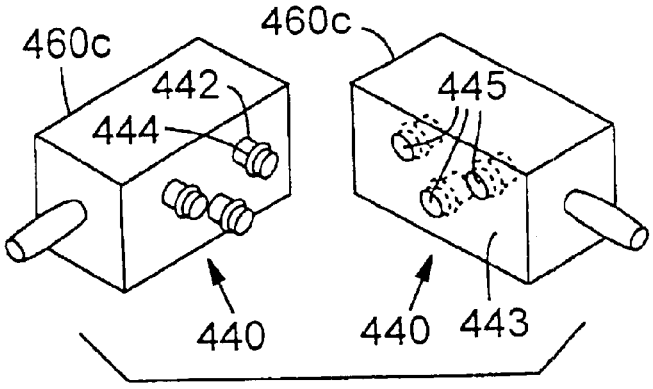
FIG. 4C is a perspective view of contact modules comprising male and female coupling features, in accordance with another embodiment of the invention.

FIG. 4C is a perspective view of contact modules 460*c* having a coupling feature 440 in the form of a protruding male feature 442 and socket female feature 443, in accordance with another embodiment of the invention. The male and female features 442, 443 are adapted to closely nest together in sliding engagement. In yet another embodiment, a detent ridge 444 on the male feature 442 is adapted to click into a detent trough 445 on the female feature 443 to securely but removably couple the contact modules 460*c* together such that the male and female features 442, 443 do not slidingly disengage.

Figure 4D:
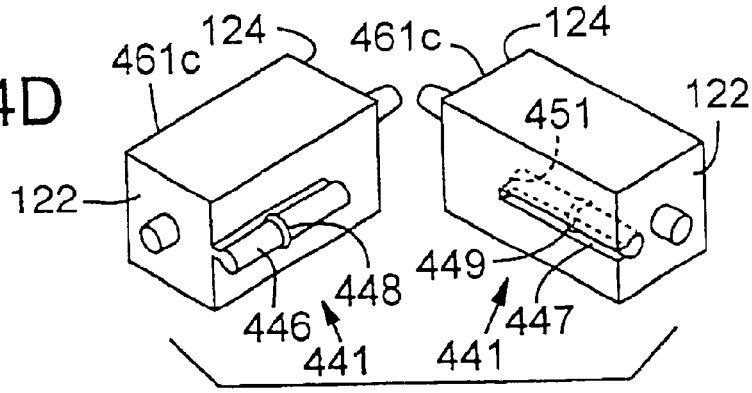
FIG. 4D is a perspective view of contact modules comprising tongue and groove coupling features, in accordance with another embodiment of the invention.

FIG. 4D is a perspective view of center contact modules 461*c* having a coupling feature 441 in the form of a tongue 446 and groove 447, in accordance with another embodiment of the invention. The tongue and groove features 446, 447 are adapted to closely nest together in sliding engagement. The tongue and groove features 446, 447 extend a predetermined distance from the front side 122 towards the back side 124 defining a stop 451. The stop 451 is adapted to stop the sliding engagement at a position that aligns the front sides 122 in coplanar relationship. In yet another embodiment, a detent ridge 448 on the tongue feature 446 is adapted to click into a detent trough 449 on the groove feature 447 to securely but removably couple the contact modules 461*c* together such that the tongue and groove features 446, 446 do not slidingly disengage in the opposite direction.

It is understood that the scope of the invention is not limited to a passive contact in the form of "J"-shaped metal strip. It is also within the scope of the invention that other passive contacts and their variations can be used for substantially the same purpose.

Figure 5:
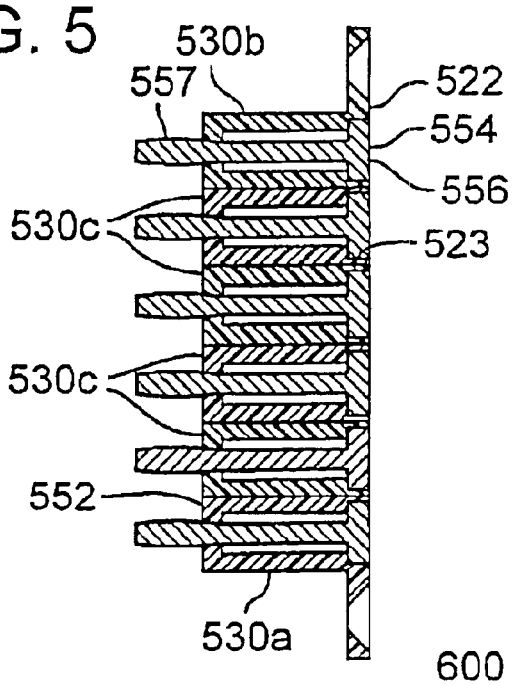
FIG. 5 is a cross-sectional view of a passive modular contact assembly in accordance with another embodiment of the invention.

FIG. 5 is a cross-sectional view of a passive modular contact assembly 500 in accordance with another embodiment of the invention. First, second and center contact housings 530*a–c* are again the same whether used for passive contact modules 552, or as active contact modules (not shown). The contact housings 530*a–c* are substantially similar to the contact housings 130*a–c* previously described, except for the absence of the passive contact apertures 153 and the addition of a passive contact head cup 523. The passive contact head cup 523 does not interfere with the operation of the active contact (not shown) which operates in substantially the same way as the active contact 114 previously described.

The passive contact 554 comprises a passive contact head 556 and an elongated tail 557 forming a "tee"-shaped member, as shown in FIG. 5. The passive contact head cup 523 is adapted to accept the passive contact head 556 such that the passive contact head 556 is flush with the front side 522. In other embodiments, the face 156 will be recessed into the front side 522, or extends a predetermined distance above the front side 522.

In another embodiment in accordance with the invention, the modular contact switch comprises two active contact assemblies 110. In some installations it is advantageous to have spring-loaded contacts on both sides of the switch, as will be discussed below.

In another embodiment in accordance with the present invention, a one-circuit contact switch is provided comprising two one-circuit contact assemblies. The one-circuit contact assemblies comprise two end modules, wherein one module has the requisite contacts, and the other does not have a contact therein. In another embodiment, a "blank" module is provided; that is, a module having a solid front surface with neither the active nor passive contact apertures. The solid front surface provides an aesthetically-pleasing appearance. In addition, blank modules may be provided to installations for future circuit expansion.

Figure 6:
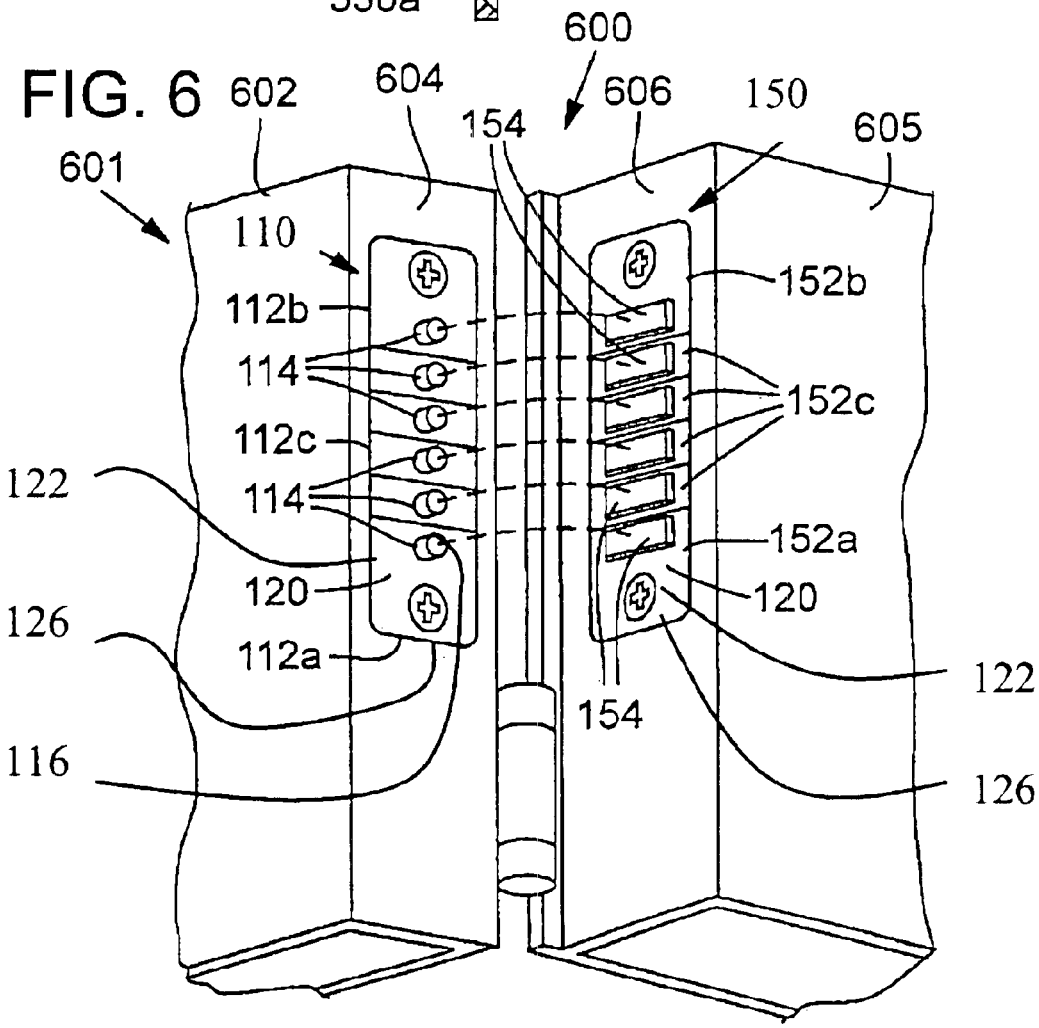
FIG. 6 is a perspective view of a modular contact switch used in a door-jamb in accordance with an embodiment of the invention.

FIG. 6 is a partial perspective view of a modular contact switch 600 suited for use in a vehicle door assembly 601 of the type having a door 602 with a moving jamb 604 and a chassis 605 having a fixed jamb 606. The door 602 pivotally moves with respect to the chassis 605, wherein when the door 602 is closed, the moving jamb 604 and the fixed jamb 606 are in close facing proximity and adjacent to each other. In one embodiment, the flange 126 is mounted in a recess such that the front side 122 is flush with the surface of the moving and fixed jamb 604, 606.

In one embodiment in accordance with the invention, the door-jamb modular contact switch 600 comprises an active contact assembly 110 and a passive contact assembly 150. The active contact assembly 110 comprises one or more active contact modules 112 and the passive contact assembly 150 comprises one or more passive contact modules 152 in one-to-one correspondence with the active contact modules 112. The active contact assembly 110 is mounted in the moving jamb 604 and the passive contact assembly 150 is mounted in the fixed jamb 606. In another embodiment, the active contact assembly 110 is mounted in the fixed jamb 606 and the passive contact assembly 150 is mounted in the moving jamb 604.

The active contact assembly 110 and a passive contact assembly 150 are positioned wherein each active contact 114 is aligned with a respective passive contact 154 when the door 602 is in a closed position. As the door 602 is closed, the active contacts 114 abut and engage the passive contacts 154 in urging engagement. The active contacts 114 are pushed into their respective contact housings 130*a–c* while exerting a restoring force against the passive contacts 154 to ensure a positive electrical coupling. Contact between respective active contacts 114 and passive contacts 154 closes respective electrical circuits in electrical communication with each of the active contacts 114 and passive contacts 154.

In another embodiment in accordance with the invention, the door-jamb modular contact switch comprises two active contact assembles 110, each comprising one or more active contact modules 112. One of the two active contact assemblies 110 is mounted in the moving jamb 604 and the other in the fixed jamb 606. When the door 602 is closed, the active contact front portions 116 of each active contact assembly 110 are in urging abutment with respective active contact front portions 116. Electrical contact between respective active contacts 114 closes the respective circuits in electrical communication with each of the active contacts 114. Electrical communication is broken when the door 602 is opened and the active contacts 114 disengage.

The active contacts 114 are biased to assume an extended position wherein each active contact 114 projects a predetermined distance outward from the front side 122, as shown in FIG. 6. However, due to the biased nature of the active contacts 114, the active contact front portion 116 is partially retracted back into the housing by their engagement with the active or passive contact assembly 110,150 mounted in the moving jamb 604 when the door 602 assumes a closed position.

Electrical wiring within the chassis 605 of the automobile is routed to and electrically interconnected with the respective contacts of the respective contact assembly mounted in the fixed jamb 606. Electrical wiring within the door 602 from the door-mounted components is routed to and electrically interconnected with the respective contacts of the respective contact assembly mounted in the moving jamb 604. Examples of electrically interconnecting the electrical wiring with the contacts include, but are not limited to, soldering and the use of clips.

In operation, when the door 602 is in the open position, the respective active contacts 114 project outwardly from the front side 122 and are exposed as shown in FIG. 6. As the door is closed, it is appreciated that the active switch assembly 110 mounted in the moving jamb 604 will move into close proximity with the passive switch assembly 150 mounted in the fixed jamb 606. As the door 602 continues to move, whether pivotal or translational, towards a closed position, the active contacts 114 will engage respective aligned passive contacts 154. Other embodiments having other switch configurations include, but are not limited to, active contacts 114 in the moving jamb 604 engage respective aligned passive contacts 154 in the fixed jamb 606, and active contacts 114 in the moving jamb 604 will each engage respective aligned active contacts 114 in the fixed jamb 606, respective of which mounting configuration is chosen.

Once the contacts 114, 154 have engaged respective contacts 114, 154, the continued closing of the door 602 will result in the contacts 114 being partially pushed into their respective housings 112. Once the door 602 has been completely closed, the active contact ends 116 of the active contacts 114 will abut into urging biased engagement with the contacts 114, 154 to effect a closed circuit. Thus, in the closed position, it is appreciated that electrical communication is now possible between door mounted electrical components and chassis-mounted electrical components, the electrical communication being transmitted between the modular contact switch 600 through the opposing moving and fixed jambs 604, 606. Upon opening of the door 602, the contacts 114, 154 disengage, breaking or opening of circuits within the modular contact switch 600.

Because of the modular nature of the modular contact switch 100, 600, additional circuits can be easily added to the existing modular contact switch 100, 600. To add additional circuits, the contact assemblies 110, 150 are unmounted from the respective jamb. The mounting hole is appropriately enlarged to accept the additional modules 112, 152. Each contact assembly 110, 150 is disassembled along one of the removable couplings at the same location. Additional center contact modules 112*c*, 152*c* are removably coupled to the contact assemblies 110, 150 as required. The contact assemblies 110, 150 are then mounted to the respective door jamb.

In another embodiment in accordance with the present invention, one or more of the contact modules 112, 152 comprise one or more contacts. In one embodiment, an end module is provided with a plurality of contacts which is coupled to an end module having one contact. This contact switch assembly is adapted to provide the number of circuits required for the initial installation with two modules, but provides for future expansion with the addition of center modules and/or end modules having additional contacts.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiment shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. A vehicle door jamb modular contact switch for transmitting electrical current through a vehicle door jamb assembly including a door jamb of a movable door and fixed door post, comprising:

an active contact assembly comprising a plurality of active contact modules, each active contact module having a biased contact active contact and a housing having one or more coupling surfaces, wherein two or more active contact modules are coupled via their coupling surfaces, the active contact assembly adapted to be mounted to the door jamb of a movable door;

a passive contact assembly comprising a plurality of passive contact modules, each passive contact module having a passive contact and a housing having one or more coupling surfaces, wherein two or more active contact modules are coupled via their coupling surfaces, the passive contact assembly adapted to be mounted within the fixed-door post, the movable door and the fixed-door post in cooperating relationship wherein the biased contact active contacts of the plurality of active contact modules are in cooperative engagement with the passive contacts of the plurality of passive contact modules and operative to mate therewith to form a closed circuit when the vehicle door assumes a closed position.

2. The modular contact switch of claim 1, wherein the active and passive contact module coupling surfaces comprises one or more tabs and corresponding notches.

3. The modular contact switch of claim 1, wherein the active and passive contact module coupling surfaces comprise one or more protruding male components and one or more interlocking female depressions adapted for cooperative engagement with one or more protruding male components.

4. The modular contact switch of claim 1, wherein the plurality of active and passive contact modules comprise a first end contact module, a second end contact module, and a center contact module, the first end contact module comprising a housing having a first coupling surface comprising a protruding male component;

the second end contact module comprising a housing having a second surface comprising a grooved female component, and the center contact module comprising a housing having a first coupling surface comprising a protruding male component, and a second surface opposite the first surface comprising a grooved female component, the protruding male component and the grooved female component adapted to slidingly couple.

5. The modular contact switch of claim 4, wherein the protruding male component is a tongue running longitudinal to the coupling side, wherein the grooved female component is a groove running longitudinal to the coupling side.

6. The modular contact switch of claim 5, wherein the at least pone protruding male component and at least one complimentary female component further comprise at least one fixation feature adapted to removably fix the engagement between the protruding male component and the complementary female component in substantial alignment therewith.

7. The modular contact switch of claim 6, wherein the at least one protruding male component further comprises at least one detent ridge and detent trough and the female component further comprises at least one complimentary detent trough and detent ridge, wherein the detent ridge and complementary detent trough are adapted to removably fix the engagement between the protruding male component and the complementary female component in substantial alignment therewith.

8. The modular contact switch of claim 6, wherein the at least one protruding male component further comprises at least one detent ridge and the female component further comprises at least one complimentary detent trough, wherein the detent ridge and complementary detent trough are adapted to removably fix the engagement between the protruding male component and the complementary female component in substantial alignment therewith.

9. The modular contact switch of claim 6, wherein the at least one protruding male component further comprises at least one detent trough and the female component further comprises at least one, complimentary detent ridge, wherein the detent ridge and complementary detent trough are adapted to removably fix the engagement between the protruding male component and the complementary female component in substantial alignment therewith.

10. The modular contact switch of claim 4, wherein the active and passive contact module coupling surfaces comprise one or more protruding male components and one or more interlocking female depressions adapted for cooperative engagement with one or more protruding male components.

11. The modular contact switch of claim 10, wherein the at least one protruding male component and at least one complimentary female component further comprise at least one fixation feature adapted to removably fix the engagement between the protruding male component and the complementary female component in substantial alignment therewith.

12. The modular contact switch of claim 11, wherein the at least one protruding male component further comprises at least one detent ridge and detent trough and the female component further comprises at least one complimentary detent trough and detent ridge, wherein the detent ridge and complementary detent trough are adapted to removably fix the engagement between the protruding male component and the complementary female component in substantial alignment therewith.

13. The modular contact switch of claim 11, wherein the at least one protruding male component further comprises at least one detent ridge and the female component further comprises at least one complimentary detent trough, wherein the detent ridge and complementary detent trough are adapted to removably fix the engagement between the protruding male component and the complementary female component in substantial alignment therewith.

14. The modular contact switch of claim 11, wherein the at least one protruding male component further comprises at least one detent trough and the female component further comprises at least one complimentary detent ridge, wherein the detent ridge and complementary detent trough are adapted to removably fix the engagement between the protruding male component and the complementary female component in substantial alignment therewith.

15. The modular contact switch of claim 4, wherein the active and passive contact module coupling surfaces comprise one or more interlocking female depressions adapted for cooperative engagement with one or more protruding male components.

16. The modular contact switch of claim 4, wherein the active and passive contact module coupling surfaces comprise one or more protruding male components adapted for cooperative engagement with one or more interlocking female depressions.

17. The modular contact switch of claim 1 wherein the active and passive contact module coupling surfaces comprise one or more interlocking female depressions adapted for cooperative engagement with one or more protruding male components.

18. The modular contact switch of claim 1, wherein the active and passive contact module coupling surfaces comprise one or more protruding male components adapted for cooperative engagement with one or more interlocking female depressions.

19. A modular electrical contact switch, comprising:

an active contact assembly comprising a first end active contact module and a second end active contact module, the first and second end active contact modules having a top side, a bottom side, a first side, a second side, a front side and a back side, the first and second end active contact modules having a spring-biased contact extending from the front side, the first end active contact module first side having a first coupling surface, the second end active contact module second side having a second coupling surface, the first and second end coupling surfaces comprise coupling features for removable coupling therebetween; and a passive contact assembly comprising a first end passive contact module and a second end passive contact module, the first and second end passive contact modules having a top side, a bottom side, a first side, a second side, a front side and a back side, the first and second end passive contact modules having a passive contact adjacent the front side, the first end passive contact module first side having a first coupling surface, the second end passive contact module second side having a second coupling surface, the first and second end coupling surfaces comprise coupling features for removable coupling therebetween, wherein contact between each active contact and passive contact closes an electrical circuit, wherein the first end active contact module comprises a first side having coupling features comprising at least one protruding male component adjacent the top side and at least one complimentary female component adjacent the bottom side, and wherein the first end passive contact module comprises a first side having coupling features comprising at least one protruding male component adjacent the top side and at least one complimentary female component adjacent the bottom side.

20. The modular contact switch of claim 19, wherein the at least one protruding male component and at least one complimentary female component further comprise at least one fixation feature adapted to removably fix the engagement between the protruding male component and the complementary female component in substantial alignment therewith.

21. The modular contact switch of claim 19, wherein the at least one protruding male component further comprises at least one detent ridge and detent trough and the female component further comprises at least one complimentary detent trough and detent ridge, wherein the detent ridge and complementary detent trough are adapted to removably fix the engagement between the protruding male component and the complementary female component in substantial alignment therewith.

22. The modular contact switch of claim 19, wherein the at least one protruding male component further comprises at least one detent ridge and the female component further comprises at least one complimentary detent trough, wherein the detent ridge and complementary detent trough are adapted to removably fix the engagement between the protruding male component and the complementary female component in substantial alignment therewith.

23. The modular contact switch of claim 19, wherein the at least one protruding male component further comprises at least one detent trough and the female component further comprises at least one complimentary detent ridge, wherein the detent ridge and complementary detent trough are adapted to removably fix the engagement between the protruding male component and the complementary female component in substantial alignment therewith.

24. A modular electrical contact switch, comprising:

an active contact assembly comprising a first end active contact module and a second end active contact module, the first and second end active contact modules having a too side, a bottom side, a first side, a second side, a front side and a back side, the first and second end active contact modules having a spring-biased contact extending from the front side, the first end active contact module first side having a first coupling surface, the second end active contact module second side having a second coupling surface, the first and second end coupling surfaces comprise coupling features for removable coupling therebetween; and a passive contact assembly comprising a first end passive contact module and a second end passive contact module, the first and second end passive contact modules having a top side, a bottom side, a first side, a second side, a front side and a back side, the first and second end passive contact modules having a passive contact adjacent the front side, the first end passive contact module first side having a first coupling surface, the second end passive contact module second side having a second coupling surface, the first and second end coupling surfaces comprise coupling features for removable coupling therebetween, wherein contact between each active contact and passive contact closes an electrical circuit, further comprising one or more center active contact modules having a top side, a bottom side, a first side, a second side, a front side and a back side, the center active contact module having a spring-biased contact extending from the front side, the center active contact module first side having coupling features comprising at least one protruding male component adjacent the top side and at least one complimentary female component adjacent the bottom side, the second side having coupling features comprising at least one female component adjacent the top side and at least one complimentary protruding male component adjacent the bottom side; and further comprising one or more center passive contact modules having a top side, a bottom side, a first side, a second side, a front side and a back side, the center passive contact module having a spring-biased contact extending from the front side, the center passive contact module first side having coupling features comprising at least one protruding male component adjacent the top side and at least one complimentary female component adjacent the bottom side, the second side having coupling features comprising a female component adjacent the top side and at least one complimentary protruding male component adjacent the bottom side, wherein the at least one protruding male component and at least one complimentary female component further comprise at least one fixation feature adapted to removably fix the engagement between the protruding male component and the complementary female component in substantial alignment therewith.

25. A modular electrical contact switch, comprising:

an active contact assembly comprising a first end active contact module and a second end active contact module, the first and second end active contact modules having a top side, a bottom side, a first side, a second side, a front side and a back side, the first and second end active contact modules having a spring-biased contact extending from the front side, the first end active contact module first side having a first coupling surface, the second end active contact module second side having a second coupling surface, the first and second end coupling surfaces comprise coupling features for removable coupling therebetween; and a passive contact assembly comprising a first end passive contact module and a second end passive contact module, the first and second end passive contact modules having a top side, a bottom side, a first side, a second side, a front side and a back side, the first and second end passive contact modules having a passive contact adjacent the front side, the first end passive contact module first side having a first coupling surface, the second end passive contact module second side having a second coupling surface, the first and second end coupling surfaces comprise coupling features for removable coupling therebetween, wherein contact between each active contact and passive contact closes an electrical circuit, further comprising one or more center active contact modules having a top side, a bottom side, a first side, a second side, a front side and a back side, the center active contact module having a spring-biased contact extending from the front side, the center active contact module first side having coupling features comprising at least one protruding male component adjacent the top side and at least one complimentary female component adjacent the bottom side, the second side having coupling features comprising at least one female component adjacent the top side and at least one complimentary protruding male component adjacent the bottom side; and further comprising one or more center passive contact modules having a top side, a bottom side, a first side, a second side, a front side and a back side, the center passive contact module having a spring-biased contact extending from the front side, the center passive contact module first side having coupling features comprising at least one protruding male component adjacent the top side and at least one complimentary female component adjacent the bottom side, the second side having coupling features comprising a female component adjacent the top side and at least one complimentary protruding male component adjacent the bottom side, wherein the at least one protruding male component further comprises at least one detent ridge and detent trough and the female component further comprises at least one complimentary detent trough and detent ridge, wherein the detent ridge and complementary detent trough are adapted to removably fix the engagement between the protruding male component and the complementary female component in substantial alignment therewith.

26. A modular electrical contact switch, comprising:

an active contact assembly comprising a first end active contact module and a second end active contact module, the first and second end active contact modules having a top side, a bottom side, a first side, a second side, a front side and a back side, the first and second end active contact modules having a spring-biased contact extending from the front side, the first end active contact module first side having a first coupling surface, the second end active contact module second side having a second coupling surface, the first and second end coupling surfaces comprise coupling features for removable coupling therebetween; and a passive contact assembly comprising a first end passive contact module and a second end passive contact module, the first and second end passive contact modules having a top side, a bottom side, a first side, a second side, a front side and a back side, the first and second end passive contact modules having a passive contact adjacent the front side, the first end passive contact module first side having a first coupling surface, the second end passive contact module second side having a second coupling surface, the first and second end coupling surfaces comprise coupling features for removable coupling therebetween, wherein contact between each active contact and passive contact closes an electrical circuit, further comprising one or more center active contact modules having a top side, a bottom side, a first side, a second side, a front side and a back side, the center active contact module having a spring-biased contact extending from the front side, the center active contact module first side having coupling features comprising at least one protruding male component adjacent the top side and at least one complimentary female component adjacent the bottom side, the second side having coupling features comprising at least one female component adjacent the top side and at least one complimentary protruding male component adjacent the bottom side; and further comprising one or more center passive contact modules having a top side, a bottom side, a first side, a second side, a front side and a back side, the center passive contact module having a spring-biased contact extending from the front side, the center passive contact module first side having coupling features comprising at least one protruding male component adjacent the top side and at least one complimentary female component adjacent the bottom side, the second side having coupling features comprising a female component adjacent the top side and at least one complimentary protruding male component adjacent the bottom side, wherein the at least one protruding male component further comprises at least one detent ridge and the female component further comprises at least one complimentary detent ridge, wherein the detent ridge and complementary detent trough are adapted to removably fix the engagement between the protruding male component and the complementary female component in substantial alignment therewith.

27. A modular electrical contact switch, comprising:

an active contact assembly comprising a first end active contact module and a second end active contact module, the first and second end active contact modules having a top side, a bottom side, a first side, a second side, a front side and a back side, the first and second end active contact modules having a spring-biased contact extending from the front side, the first end active contact module first side having a first coupling surface, the second end active contact module second side having a second coupling surface, the first and second end coupling surfaces comprise coupling features for removable coupling therebetween; and a passive contact assembly comprising a first end passive contact module and a second end passive contact module, the first and second end passive contact modules having a top side, a bottom side, a first side, a second side, a front side and a back side, the first and second end passive contact modules having a passive contact adjacent the front side, the first end passive contact module first side having a first coupling surface, the second end passive contact module second side having a second coupling surface, the first and second end coupling surfaces comprise coupling features for removable coupling therebetween, wherein contact between each active contact and passive contact closes an electrical circuit, further comprising one or more center active contact modules having a top side, a bottom side, a first side, a second side, a front side and a back side, the center active contact module having a spring-biased contact extending from the front side, the center active contact module first side having coupling features comprising at least one protruding male component adjacent the top side and at least one complimentary female component adjacent the bottom side, the second side having coupling features comprising at least one female component adjacent the top side and at least one complimentary protruding male component adjacent the bottom side; and further comprising one or more center passive contact modules having a top side, a bottom side, a first side, a second side, a front side and a back side, the center passive contact module having a spring-biased contact extending from the front side, the center passive contact module first side having coupling features comprising at least one protruding male component adjacent the top side and at least one complimentary female component adjacent the bottom side, the second side having coupling features comprising a female component adjacent the top side and at least one complimentary protruding male component adjacent the bottom side, wherein the at least one protruding male component further comprises at least one detent trough and the female component further comprises at least one complimentary detent ridge, wherein the detent ridge and complementary detent trough are adapted to removably fix the engagement between the protruding male component and the complementary female component in substantial alignment therewith.

* * * * *